United States Patent [19]

Eckles et al.

[11] 4,270,988

[45] Jun. 2, 1981

[54] CADMIUM PLATING BATHS AND METHODS FOR ELECTRODEPOSITING BRIGHT CADMIUM DEPOSITS

[75] Inventors: William E. Eckles, Cleveland Heights; Valerie M. Canaris, Parma, both of Ohio

[73] Assignee: Rohco, Inc., Cleveland, Ohio

[21] Appl. No.: 78,139

[22] Filed: Sep. 24, 1979

[51] Int. Cl.[3] ..... C25D 3/26

[52] U.S. Cl. ..... 204/50 R

[58] Field of Search ..... 204/50 R

[56] References Cited

U.S. PATENT DOCUMENTS 4,045,305 8/1977 Fong et al. ..... 204/50 R

FOREIGN PATENT DOCUMENTS 263351 5/1970 U.S.S.R. ..... 204/50 R

*Primary Examiner*—Howard S. Williams

*Attorney, Agent, or Firm*—Maky, Renner, Otto & Boisselle

[57] ABSTRACT

Cadmium electroplating baths are described which contain as a brightening agent, pyridine compounds having the formula:

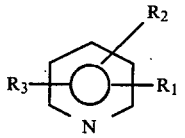

wherein $R_1$, $R_2$ and $R_3$ are each independently hydrogen, alkyl, alkoxy, alkene, mercapto, amino, halogen, aryl, arylalkyl, aminoalkyl, hydroxy, hydroxyalkyl, cyano, dialkylamide, aldoxime, pyrolidinyl groups and the corresponding N-oxide compounds. Semi-bright to bright level cadmium coatings are obtained with these baths.

12 Claims, No Drawings

CADMIUM PLATING BATHS AND METHODS FOR ELECTRODEPOSITING BRIGHT CADMIUM DEPOSITS

BACKGROUND OF THE INVENTION

The invention relates to the electrodeposition of cadmium and, particularly to a plating bath for plating bright level cadmium deposits from aqueous acid cadmium baths. More particularly, the invention relates to the incorporation into the acid cadmium baths of at least one pyridine brightener composition. The invention also relates to methods for electrodepositing level and bright cadmium deposits from such baths.

A variety of plating baths have been developed and employed for electroplating cadmium onto metallic substrates. These baths typically utilize sulfates and cyanides as the primary electrolytes. The cyanide baths have proven effective and generally satisfactory despite certain objectionable features such as high toxicity, low current efficiency and hydrogen embrittlement of certain steels. The sulfate baths which have been suggested overcome many of the objectionable features of the cyanide baths. However, some of the sulfate-based baths contain such components as ammonium ions and chelating agents. Because of the ability of these agents to complex with heavy metal ions, there is a significant increase in the difficulty of eliminating heavy metals from spent baths. Sulfate-based baths which do not utilize ammonium ions or chelating agents have more recently been suggested in the prior art. For example, in U.S. Pat. No. 3,998,707, an aqueous acidic cadmium electrolytic bath composition is described which comprises cadmium ions, free acid, and a particular surfactant combination which comprises a cationic polyoxyalkylated amine and an anionic surfactant. Preferably the cadmium plating bath also contains at least one non-sulfur containing brightener. Examples of non-sulfur containing brighteners include aryl aldehydes such as anisic aldehyde, ring halogenated aryl aldehydes such as orthochlorobenzaldehyde, heterocyclic aldehydes such as thiophenealdehyde, aryl olefinic-conjugated ketones such as benzylidine acetone, heterocyclic carboxylic acids such as nicotinic acid. The combination of orthochlorobenzaldehyde and benzoyl pyridine is shown in Example 3. Similarly, U.S. Pat. No. 4,045,305 describes cadmium plating baths which contain cadmium ions, free acid, a surfactant combination comprising a condensed naphthalene sulfonate compound and a non-ionic polyoxyalkylated surfactant. Preferably this bath also contains a non-sulfur containing brightener of the type described in U.S. Pat. No. 3,998,707.

SUMMARY OF THE INVENTION

The present invention relates to the discovery that a bright and level cadmium electrodeposit can be obtained from aqueous acid plating baths containing cadmium ions, free acid, at least one anionic compound selected from the group consisting of aromatic or aliphatic sulfonic acids, aliphatic sulfates, or bath-soluble salts thereof and at least one pyridine brightener composition having the formula

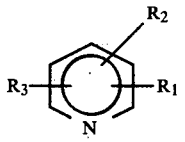

wherein $R_1$, $R_2$ and $R_3$ are each independently hydrogen, alkyl, alkoxy, alkene, mercapto, amino, halogen, aryl, arylalkyl, aminoalkyl, hydroxy, hydroxyalkyl, cyano, dialkylamide, aldoxime, pyrolidinyl groups and the corresponding N-oxide compounds.

The acid cadmium plating baths of the invention also may contain, and preferably contain, at least one non-ionic polyoxyethylene compound. The plating baths of the invention are effective over a wide current density range.

DESCRIPTION OF THE PREFERRED EMBODIMENTS

The cadmium plating baths of the present invention comprise cadmium ions, free acid, at least one anionic compound and at least one pyridine brightener composition as hereinafter defined.

The cadmium ion in the plating bath can be supplied from bath soluble compounds such as cadmium sulfate, cadmium fluoborate and cadmium oxide. The cadmium oxide forms a soluble cadmium salt in combination with the ions otherwise introduced into the plating bath. The plating baths may contain from about 5 to about 75 grams per liter of cadmium ions and preferably contains from about 8 to about 50 grams per liter.

The free acid utilized in the preparation of the plating baths of the invention preferably are either sulfuric or fluoboric acid or mixtures thereof, and the amount of free acid incorporated into the bath may range from about 50 to 175 grams per liter is preferably from about 75 to about 160 grams per liter. The plating baths of the invention also contain at least one anionic compound selected from the group consisting of aromatic or aliphatic sulfonic acids, aliphatic sulfates, and bath-soluble salts thereof.

Aromatic sulfonic acids or salts are useful additives to the plating baths and these include the acids and salts having the general formula

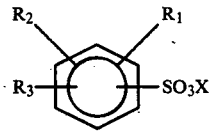

(I)

or

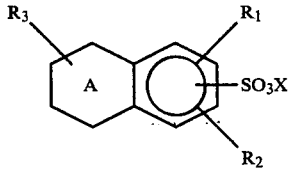

(II)

wherein $R_1$, $R_2$ and $R_3$ are each independently hydrogen or lower alkyl groups, X is hydrogen, ammonia or any metal with the proviso that the metal sulfonate is soluble in the bath, and A is a saturated, unsaturated or aromatic ring. As can be seen from the formulas, the sulfonic acids may be derived from benzene sulfonic acids, naphthalene sulfonic acids and di- or tetrahydronaphthalene sulfonic acids. The lower alkyl groups may be straight or branched chain and may contain up to about 6 carbon atoms. The aromatic sulfonic acids and salts of formula I containing two alkyl groups have been found to be particularly effective in the acid plating baths of the invention. Of the metals included in the salts of the sulfonic acids, the alkali metals, particularly sodium, are preferred.

Examples of aromatic sulfonic acids which are useful in the acid plating baths of the invention include benzene sulfonic acid, toluene sulfonic acid, isopropylbenzene sulfonic acid, xylene sulfonic acid, diethylbenzene sulfonic acid, naphthalene sulfonic acid, methylnaphthalene sulfonic acid, dimethylnaphthalene sulfonic acid, tetrahydronaphthalene sulfonic acid, etc. The aromatic sulfonic acids preferably are added to the acid cadmium plating baths in the form of their salts which may be metal salts or an ammonium salt. Any metal can be used to form the metal salts of the aromatic sulfonic acids so long as the metal does not cause any detrimental effects in the plating bath or render the sulfonates insoluble in the plating bath.

Some commercially available examples of aromatic sulfonic acids which may be used include: a bath-soluble salts of tetrahydronaphthalene sulfonic acid such as those available from DuPont; a bath-soluble salt of a xylene sulfonic acid such as those available from Arco Chemical Company under the general trade designation "Ultrawet"; an alkyl aryl sulfonate available from DuPont under the trade designation "Alkanol TD"; and a bath-soluble salt of cumyl sulfonic acid.

The anionic aromatic sulfonic acids included in the baths of the invention also may be compounds obtained by the polycondensation of formaldehyde and an aromatic sulfonic acid which generally is a naphthalene sulfonic acid. Condensation products of this type which are useful in the plating baths of the invention have the formula

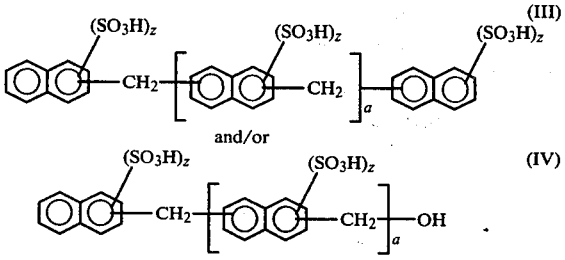

wherein each z is independently an integer from 1 to 3 and each a is independently an integer from 1 to 14, preferably from 2 to 6. Polycondensation products of this type are known compounds and their production is described in, for example, Houben-Weyl, "Methoden Der Organishen Chemie", Volume XIV/2 at page 316, and said description is hereby incorporated by reference. The utility of anionic aromatic sulfonic acid products in acid cadmium baths is described in U.S. Pat. Nos. 3,998,707 and 4,045,305. Compounds of these types are available commercially from a variety of sources.

The general method of preparing these polycondensation products involves reaction of a formaldehyde solution with naphthalene sulfonic acid at a temperature of from about 60° to about 100° C. until the formaldehyde odor has disappeared. Similar products can be obtained by sulfonation of naphthalene formaldehyde resins. The condensation products obtained in this manner contain two or more naphthalene sulfonic acids linked by methylene bridges which can have from one to three sulfonic acid groups.

These condensed aromatic sulfonic acid compounds may be introduced into the plating baths either in their acid form or as the water-soluble salts which may be the sodium or potassium salts.

Aliphatic sulfonic acids and sulfates, and their bath soluble salts also can be used as the anionic compound in the baths of the invention. Such sulfonic acids and sulfates generally may be derived by known sulfonation and sulfation reactions from long chain alcohols containing from about 6 to 20 carbon atoms or more and the carbon chain may contain one or more double or triple bonds. Examples of such alcohols include hexanol, octyl alcohol, lauryl alcohol, stearyl alcohol. Specific examples of these anionic compounds useful in the baths of the invention include sodium lauryl sulfonate, sodium lauryl sulfate, sodium octyl sulfonate, sodium octyl sulfate. Another group of sulfates are ether sulfates such as obtained by reacting alcohols with, e.g., ethylene oxide, and thereafter sulfating with sulfuric acid. One example of a commercially available product of this type is sodium laureth sulfate available from Henkel, Inc., U.S.A. under the trademark "Avirol-100E".

The amount of the above-described anionic compounds included in the cadmium plating baths of the invention may be varied depending on the other ingredients in the plating bath but should be an amount which is effective to improve the brightness, and preferably also the ductility and malleability of the cadmium deposit obtained from the baths. Generally amounts of from about 0.05 to about 20 grams per liter of plating bath.

The plating baths of the invention also contain, as a brightener, at least one pyridine composition having the formula

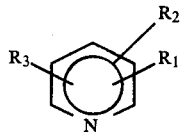

wherein $R_1$, $R_2$ and $R_3$ are each independently hydrogen, alkyl, alkoxy, alkene, mercapto, amino, halogen, aryl, arylalkyl, aminoalkyl, hydroxy, hydroxyalkyl, cyano, dialkylamide, aldoxime, pyrolidinyl groups and the corresponding N-oxide compounds. The alkyl, alkoxy and alkene groups will generally be lower alkyl, alkoxy or alkene groups containing up to six carbon atoms. The aryl groups may contain one or more groups attached to the aromatic moiety including lower alkyl, hydroxy, amino and halogen groups.

The pyridine compounds of the type represented by formula V are available and well known compounds. For example, most of the compounds listed in Table I below are available from the Aldrich Chemical Company, Milwaukee, Wisconsin. Mixtures of the pyridine compositions may be included in the plating baths. The amount of pyridine composition included in the cadmium baths of the invention is an amount which is effective to provide a bright or semi-bright and level cadmium deposit as desired. Generally amounts of from about 0.05 to 10 grams per liter of bath will provide satisfactory semi-bright to bright deposits over a wide current density range.

The properties of the cadmium deposited from the aqueous acidic baths of the invention may be enhanced further by including in the bath at least one nonionic polyoxyalkylene compound. A preferred type of such compound is the polyoxyalkylated naphthols which are obtained by reacting a naphthol with an alkylene oxide such as ethylene oxide and propylene oxide, and more particularly, with from about 6 to about 40 moles of ethylene oxide per mole of naphthol. The naphthol reactant may be either alpha or beta naphthol and the naphthalene ring may contain various substituents such as alkyl groups or alkoxy groups, especially lower alkyl and lower alkoxy groups of up to about 7 carbon atoms each, so long as the polyoxyalkylated naphthol remains bath-soluble. When present, there usually will not be more than two such substituents per poly-oxyalkylated naphthol; that is, two lower alkoxy groups, two lower alkyl groups, or a lower alkyl or a lower alkoxy group. The preferred polyoxyalkylated naphthols are ethoxylated naphthols having the formula

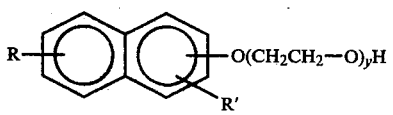

(VI)

wherein y is from about 6 to about 40 and preferably from about 8 to about 20 and R and R' are each independently hydrogen alkoxy or alkyl groups containing up to 7 carbon atoms. Derivatives of beta naphthol are preferred. The amount of polyoxyalkylated naphthol, when included in the baths of the invention, may vary within the range of from about 0.1 to about 20 grams or more per liter of bath.

The cadmium plating baths may contain, in lieu of or in addition to the ethoxylated naphthols described above, one or more non-ionic or cationic alkylene oxide condensate surfactants. Examples of such surfactants include ethoxylated alkyl phenols, ethoxyolated fatty alcohols, ethoxylated fatty acids, ethoxylated fatty acid amides, ethoxylated fatty amines, polyethylene oxide condensates, block copolymers of ethylene oxide and propylene oxide based on propylene glycol or ethylene glycol, and sulfonated ethoxylated aliphatic amines. Generally the surfactants will contain up to about 40 or more ethylene oxide units. The amount of nonionic or cationic ethylene oxide condensate included in the baths of the invention may vary over a wide range although when added to the bath it is preferred to include from about 0.5 to about 10 g/l of the condensate in the bath.

The ethoxylated alkyl phenols may be represented by the formula

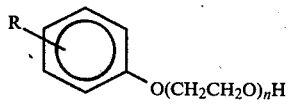

(VII)

wherein R is an alkyl group containing up to about 20 carbon atoms and n is an integer from about 10 to about 30. Preferably the alkyl group contains from about 6 to 20 carbon atoms. Examples of such alkyl groups include octyl, isooctyl, nonyl, dodecyl, octadecyl. Ethoxylated alkyl phenols are available commercially under a variety of trademarks such as "Surfonic" from Jefferson Chemical Co., "Renex" from Atlas Chemical Industries, Inc., and "Igepal" from GAF Corporation Chemical Products.

Polyethylene oxide or polyethylene glycol condensates having different molecular weights also are useful. Condensates of this type which may be represented by the general formula $$HO(CH_2CH_2O)_nH \qquad \text{(VIII)}$$

wherein n is an integer from about 5 to about 100 or more are known in the art and are commercially available such as for example under the general trade designation Carbowax from Union Carbide. Specific examples include Carbowax No. 1000 which has a molecular weight range of from about 950 to 1050 and contains from 20 to 24 ethoxy units per molecule. Carbowax No. 4000 has a molecular weight range of from about 3000 to 3700 and contains from 68 to 85 ethoxy units per molecule.

Ethoxylated aliphatic alcohols are useful as surfactants in the plating baths of the invention and may be characterized by the formula $$RO(CH_2CH_2O)_n—H \qquad \text{(IX)}$$

wherein R is an alkyl group containing from about 8 to 24 carbon atoms and n is an integer of from 5 to about 30. Fatty alcohols such as oleyl and stearyl are preferred examples. A number of ethoxylated aliphatic alcohols are available commercially such as from Emery Industries under the general trademark "Trycol". A specific example is "Trycol OAL-23" which is an ethoxylated oleyl alcohol.

The surfactant also may be an ethoxylated fatty acid represented by the formula $$RC(O)—O(CH_2CH_2O)_nH \qquad \text{(X)}$$

or an ethoxylated fatty acid amide represented by the formula $$RC(O)—N(H)(CH_2CH_2O)_nH \qquad \text{(XI)}$$

wherein R is an alkyl carbon chain containing from about 8 to 24 carbon atoms and n is an integer from about 5 to about 20.

The ethoxylated fatty acid can be obtained by reacting ethylene oxide with a fatty acid such as oleic acid, stearic acid, palmitic acid, etc. The ethoxylated fatty acids are available commercially such as from Armak Industries, Chemical Division under the trademark "Ethofat". Specific examples are: Ethofat C/15, coco acid ethoxylated with 5 moles of ethylene oxide, and Ethofats 0/15and 0/20, which are oleic acid reacted with 5 and 10 moles of ethylene oxide respectively. The ethoxylated fatty acid amides can be obtained by reacting ethylene oxide with a fatty acid amide such as oleamide, stearamide, coconut fatty acid amides and lauric amide. The ethoxylated fatty acid amides, which may also be identified as ethoxylated alkylolamides are commercially available from, for example, The Stepan Chemical Company under the general trade designation Amidox, and from Armak under the trademark ETHOMID.

Another type of nonionic ethoxylated surfactant which is useful in the plating baths of the invention are block copolymers of ethylene oxide and propylene oxide based on a glycol such as ethylene glycol or propylene glycol. The copolymers based on ethylene glycol generally are prepared by forming a hydrophilic base by reaction of ethylene oxide with ethylene glycol followed by condensation of this intermediate product with propylene oxide. The copolymers based on propylene glycol similarly are prepared by reacting propylene oxide with propylene glycol to form the intermediate compound which is then condensed with ethylene oxide. By varying the proportions of ethylene oxide and propylene oxide used to form the above copolymers, the properties may be varied. Both of the above types of copolymers are available commercially such as from BASF Wyandotte under the general trademark PLURONIC. The condensates based on ethylene glycol are identified as the "R" series, and these compounds preferably contain from about 30 to about 80% of polyoxyethylene in the molecule and may be either liquids or solids. The condensates based on propylene glycol are identified generally by BASF Wyandotte as the "F", "L", or "P" series and these may contain from about 5 to about 80% of ethylene oxide. The "L" series of propylene glycol based copolymers are liquids, the "F" series are solids and the "P" series are pastes. The solids and pastes can be used when they are soluble in the bath formulation. The molecular weights of these block copolymers range from about 400 to about 1400.

One type of cationic surfactant which may be included in the cadmium baths of the invention are the ethoxylated amines and particularly the ethoxylated fatty amines which can be prepared by condensing ethylene oxide with fatty acid amines by techniques known to those in the art. The alkoxylated amines which may be utilized in the plating baths of the invention may be represented by the following formulas

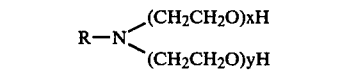

(XII)

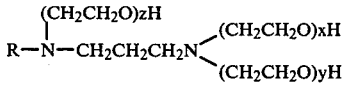

(XIII)

wherein R is a fatty amine alkyl group containing from 8 to 22 and preferably 12 to 18 carbon atoms, and x, y and z are each independently integers from 1 to about 30, and the sum of x, y and z is an integer of from 3 to about 50.

The above described alkoxylated amines are known in the art and are available from a variety of commercial sources. The amines of the type represented by formula XII can be prepared by condensing various amounts of ethylene oxide with primary fatty amines which may be a single amine or a mixture of amines such as are obtained by the hydrolysis of tallow oils, sperm oils, coconut oils, etc. Specific examples of fatty amines containing from 8 to 22 carbon atoms include saturated as well as unsaturated aliphatic amines such as octyl amine, decyl amine, lauryl amine, stearyl amine, oleyl amine, myristyl amine, palmityl amine, dodecyl amine and octadecyl amine.

The above described amines can be prepared, as mentioned above, by condensing alkylene oxides with the above-described primary amines by techniques known to those in the art. A number of such alkoxylated amines is commercially available from a variety of sources. The alkoxylated amines of the type represented by formula XII are available from the Armak Chemical Division of Akzona, Inc., Chicago, Illinois, under the general trade designation "Ethomeen". Specific examples of such products include "Ethomeen C/15" which is an ethylene oxide condensate of a coconut fatty amine containing about 5 moles of ethylene oxide; "Ethomeen C/20" and "C/25" which also are ethylene oxide condensation products from coconut fatty amine containing about 10 and 15 moles of ethylene oxide respectively; "Ethomeen S/15" and "S/20" which are ethylene oxide condensation products with stearyl amine containing about 5 and 10 moles of ethylene oxide per mole of amine respectively; and "Ethomeen T/15" and "T/25" which are ethylene oxide condensation products of tallow amine containing about 5 and 15 moles of ethylene oxide per mole of amine respectively. Commercially available examples of alkoxylated amines of the type represented by formula XIII include "Ethoduomeen T/13" and "T/20" which are ethylene oxide condensation products of N-tallow trimethylene diamine containing about 3 and 10 moles of ethylene oxide per mole of diamine respectively.

The use of these cationic polyoxyalkylated amines as surfactants in cadmium plating baths is described in U.S. Pat. No. 3,998,707.

Another class of alkoxylated nonionic surfactants which optionally may be included in the cadmium plating baths of the invention are polymeric sulfur-containing compositions having the general formula $$RS(R'O)_n—H, \quad (XIV)$$

or $$S[(R'O)_n—H]_2 \quad (XV)$$

wherein R is an alkyl group containing up to about 24 carbon atoms, each R' is independently an alkylene group containing 2 to 3 carbon atoms, and each n is independently an integer up to about 100. The compositions according to formula XIV can be prepared by reacting a mercaptan with an excess of ethylene or propylene oxide or mixtures of such oxides. an alkaline catalyst generally is used in promoting the condensation reaction. Examples of alkaline catalysts include alkali metal hydroxides, oxides and alcoholates. The preparation of compounds represented by formula XIV is described in more detail in U.S. Pat. No. 2,494,610 which disclosure is hereby incorporated by reference.

Compounds of the type represented by formula XV can be prepared by reacting one mole hydrogen sulfide, 2-hydroxyethyl sulfide or 3-hydroxypropyl sulfide with from one to 100 moles of ethylene or propylene oxide or mixtures of such oxides. Preferably, an excess of the oxide and an alkaline catalyst can be employed.

In one preferred embodiment, the sulfur-containing composition is derived from one mole hydrogen sulfide or 2-hydroxyethyl sulfide and up to 100 moles of ethylene oxide. In another embodiment, the hydrogen sulfide is replaced by a mercaptan containing 6 to 24 carbon atoms.

Polymeric sulfur-containing compositions of the type useful in the plating baths of this invention are available from, for example, Crucible Chemical Company, Greenville, S.C. These compounds are available containing various ratios of ethylene and/or propylene oxide to hydrogen sulfide, 2-hydroxymethyl sulfide or mercaptan. One such compound is available under their general trade designation CRU-PEG HS-1000 which is believed to be the reaction product of one mole of hydrogen sulfide or 2-hydroxyethyl sulfide with 23 or 21 moles of ethylene oxide and having a molecular weight of about 1040. Another example is the product identified as CRU-PEG HS-2000 which is believed to be the reaction product of one mole of hydrogen sulfide or 2-hydroxyethyl sulfide with 46 or 44 moles of ethylene oxide.

The amount of polymeric sulfur-containing compositions incorporated into the aqueous acidic cadmium plating baths of the invention is an amount which will be sufficient to improve the performance of the plating bath and particularly improve the brightness over a wide current density range. The plating baths of the invention may contain from about 0.05 to about 20 grams of the sulfur-containing compositions per liter of bath.

The cadmium plating baths of the invention may be utilized to produce bright to semi-bright cadmium deposits on all types of metals and alloys, for example, on iron (cast or maileable), steel, copper and brass. The electroplating baths may be employed in all types of industrial cadmium plating baths including still plating baths, high-speed plating baths for strip or wire plating, and in barrel plating.

The plating baths of the invention may be operated on a continuous or intermittent basis, and from time to time, the components of the bath may have to be replenished. The various components may be added singularly as required or may be added in combination. The amounts of the various compositions to be added to the plating baths may be varied over a wide range depending on the nature and performance of the plating bath to which the composition is added. Such amounts can be determined readily by one skilled in the art.

Examples of typical acid cadmium plating baths to which the herein-described pyridine brightener compounds may be added in accordance with the invention are as follows:

| Bath | Ingredients | Amounts |
|---|---|---|
| A | CdO | 30 g/l |
| | $H_2SO_4$(66° Baumé) | 150 g/l |
| | Sodium xylene monosulfonate | 4 g/l |
| | water | to make 1 liter |
| B | $CdSO_4$ | 28 g/l |
| | $H_2SO_4$ | 80 g/l |
| | Blancol N (sodium salt of an ethoxylated sulfonated naphthalene condensate from GAF Corp.) | 3 g/l |
| | Ethoxylated beta-naphthol (12 moles EtO) | 1.5 g/l |
| | water | to make 1 liter |
| C | CdO | 30 g/l |
| | $H_2SO_4$ | 150 g/l |
| | Alkanol TD (an alkyl aryl sulfonate from DuPont) | 4.0 g/l |
| | Ethoxylated beta-naphthol (12 moles EtO) | 2.25 g/l |
| | water | to make 1 liter |
| D | CdO | 30 g/l |
| | $H_2SO_4$ | 80 ml/l |
| | Alkanol TD | 3.75 ml/l |
| | Ethoxylated beta-naphthol (12 moles of EtO) | 2.25 g/l |
| | water | to make 1 liter |
| E | CdO | 30 g/l |
| | Fluoboric acid (47% w. aqueous solutions) | 180 ml/l |
| | Sodium xylene monosulfonate | 4 g/l |
| | Surfynol 465 (tetramethyl decynediol ethoxylated with ten moles of EtO, available from Air Products) | 2 g/l |
| | water | to make 1 liter |

In the following examples of the invention, the pyridine derivatives are added to the Bath D in the amounts indicated in the table. Steel panels are plated in a 267 ml. Hull cell containing the baths of the invention. The panels are plated for five minutes at a current density of two amperes with no agitation. Current density ranges are measured with a Hull cell scale. The results are summarized in the following table.

CADMIUM PLATING BATHS CONTAINING PYRIDINE DERIVATIVES AND PLATING RESULTS*

| Example | Pyridine derivative | Concentration (g/l) | Result |
|---|---|---|---|
| 1 | 4-pyridine aldoxime | 1.0 | Bright plate from 0.2 to above 8.0 |
| 2 | 3,4-dimethylpyridine | 6.75 | Bright from 1.2 to above 8.0 |
| 3 | 4-benzylpyridine | 0.2 | Bright from 0.1 to above 8.0 |
| 4 | 3-bromopyridine | 0.75 | Bright from 0.1 to above 8.0 |
| 5 | Quinaldine | 0.75 | Bright to semi-bright from below 0.1 to 6.0 |
| 6 | 3-picoline-N-oxide | 2.25 | Bright from 1.2 to above 8.0 |
| 7 | 2-aminopyridine | 3.75 | Semi-bright from below 0.1 to 4.0; bright above 4.0 |
| 8 | 3-aminopyridine | 3.75 | Semi-bright from below 0.1 to above 8.0 |
| 9 | 2,6-diaminopyridine | 4.5 | Semi-bright from below 0.1 to above 8.0 |
| 10 | 3-picoline | 0.3 | Bright from 0.1 to above 8.0 |
| 11 | 4-picoline | 0.3 | Semi-bright from below 0.1 to above 3.0; bright above 3.0 |
| 12 | 3-aminomethylpyridine | 0.6 | Semi-bright to bright from below 0.1 to above 8.0 |
| 13 | 2-amino-4-picoline | 6.0 | Semi-bright from below 0.1 to above 8.0 |
| 14 | 2-amino-3-hydroxy-pyridine | 4.5 | Semi-bright to bright from below 0.2 to above 8.0 |
| 15 | 3-chloropyridine | 0.75 | Bright from 0.1 to above 8.0 |
| 16 | 3,5-dichloropyridine | 0.375 | Bright from 0.1 to above 8.0 |
| 17 | 4-tert-butylpyridine | 0.75 | Semi-bright from below 0.5; bright above 0.5 |
| 18 | 4-bromopyridine | 1.0 | Semi-bright to bright from below 0.1 to above 8.0 |
| 19 | 3-cyanopyridine | 1.0 | Semi-bright to bright from 0.1 to above 8.0 |
| 20 | N,N-diethylnicotinamide | 1.0 | Semi-bright to bright from below 0.1 to above 8.0 |

-continued

CADMIUM PLATING BATHS CONTAINING PYRIDINE DERIVATIVES AND PLATING RESULTS*

| Example | Pyridine derivative | Concentration (g/l) | Result |
|---|---|---|---|
| 21 | pyridine | 1.0 | Bright from below 0.1 to above 8.0 |
| 22 | 2,6-dimethoxypyridine | 0.75 | Semi-bright from below 0.1 to above 8.0 |
| 23 | 3-hydroxypyridine | 0.375 | Bright from 0.2 to above 8.0 |
| 24 | 4-vinylpyridine | 0.375 | Bright to semi-bright from 0.1 to above 8.0 |
| 25 | 4-methoxypyridine | 3.75 | Semi-bright from below 0.1 to above 8.0 |
| 26 | 3-pyridylcarbinol-N-oxide | 0.2 | Bright from 0.2 to above 8.0 |
| 27 | 3,5-lutidine | 0.75 | Bright from 0.1 to above 8.0 |
| 28 | 4-mercaptopyridine | 0.6 | Semi-bright to bright from below 0.1 to above 8.0 |
| 29 | 2-methoxypyridine | 3.75 | Bright to semi-bright from below 0.1 to above 8.0 |
| 30 | 2,4-lutidine | 2.0 | Semi-bright to bright from below 0.1 to above 8.0 |
| 31 | 2,4,6-collidine | 5.0 | Semi-bright below 0.1 to above 8.0 |

*Current density values in $A/dm^2$

We claim:

1. An aqueous electroplating bath for the electrodeposition of cadmium comprising
   (a) cadmium ions
   (b) a free acid
   (c) at least one anionic compound selected from the group consisting of aromatic or aliphatic sulfonic acids, aliphatic sulfates, or bath-soluble salts thereof, and
   (d) at least one pyridine brightener composition having the formula

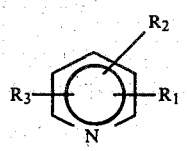

wherein $R_1$, $R_2$ and $R_3$ are each independently hydrogen, alkyl, alkoxy, alkene, mercapto, amino, halogen, aryl, arylalkyl, aminoalkyl, hydroxy, hydroxyalkyl, cyano, dialkylamide, aldoxime, or pyrolidinyl groups and the corresponding N-oxide compounds.

2. The plating bath of claim 1 wherein the bath also contains at least one nonionic polyoxyalkylene compound.

3. A plating bath of claim 2 wherein the nonionic polyoxyalkylene compound is a polyoxyethylated naphthol having the formula

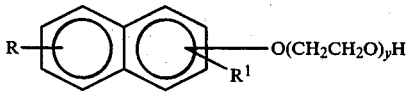

wherein y is from about 6 to about 40, and R and $R^1$ are each independently hydrogen, alkoxy or alkyl groups containing up to seven carbon atoms.

4. The plating bath of claim 3 wherein the polyoxyethylated naphthol is derived from a beta-naphthol.

5. The plating bath of claim 4 wherein the anionic compound is a benzene, xylene or cumene sulfonic acid or bath-soluble salt thereof.

6. The plating baths of claim 1 or 2 wherein the baths also contain at least one cationic polyoxyalkylated amine.

7. The plating bath of claim 1 wherein the free acid is sulfuric acid, fluoboric acid and mixtures thereof.

8. The plating bath of claim 1 wherein the anionic compound is an aromatic sulfonic acid or salt thereof having the general formula

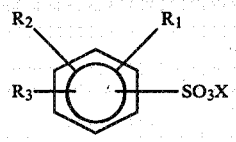

or

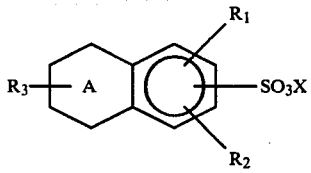

wherein $R_1$, $R_2$ and $R_3$ are each independently hydrogen or lower alkyl groups X is hydrogen, ammonia or any metal with the proviso that the metal sulfonate is soluble in the plating bath, and A is a saturated or aromatic ring.

9. The plating bath of claim 1 wherein the bath contains from about 0.05 to about 10 grams per liter of the brightener composition.

10. The plating bath of claim 1 wherein the anionic compound is present in amounts of from about 0.05 to about 20 grams or more per liter of bath.

11. The plating bath of claim 1 wherein the anionic compound is a condensed naphthalene sulfonic acid.

12. A process of electrodepositing a cadmium coating on a substrate which comprises electroplating said substrate with a cadmium plating bath according to any one of claims 1 through 11.

* * * * *